US009211433B2

(12) United States Patent
Hall

(10) Patent No.: US 9,211,433 B2
(45) Date of Patent: Dec. 15, 2015

(54) SWIMMING RESISTANCE TRAINER

(71) Applicant: Roxy Development, LLC, Tavernier, FL (US)

(72) Inventor: Gary W. Hall, Tavernier, FL (US)

(73) Assignee: Roxy Development, Tavernier, FL (US)

( * ) Notice: Subject to any disclaimer, the term of this patent is extended or adjusted under 35 U.S.C. 154(b) by 0 days.

(21) Appl. No.: 14/528,859

(22) Filed: Oct. 30, 2014

(65) Prior Publication Data

US 2015/0141210 A1 May 21, 2015

Related U.S. Application Data

(63) Continuation of application No. 13/507,455, filed on Jun. 29, 2012, now abandoned.

(51) Int. Cl.

| | |
|---|---|
| ***A63B 31/00*** | (2006.01) |
| ***A63B 21/055*** | (2006.01) |
| ***A63B 69/10*** | (2006.01) |
| ***A63B 21/062*** | (2006.01) |
| ***A63B 22/00*** | (2006.01) |

(Continued)

(52) U.S. Cl.

CPC ..... *A63B 21/0552* (2013.01); *A63B 21/00185* (2013.01); *A63B 21/062* (2013.01); *A63B 21/1426* (2013.01); *A63B 21/1461* (2013.01); *A63B 21/1465* (2013.01); *A63B 21/1484* (2013.01); *A63B 21/154* (2013.01); *A63B 22/0012* (2013.01); *A63B 22/203* (2013.01); *A63B 23/03575* (2013.01); *A63B 69/10* (2013.01); *A63B 31/00* (2013.01); *A63B 2208/0257* (2013.01); *A63B 2244/20* (2013.01)

(58) Field of Classification Search

CPC ..... A63B 31/00; A63B 31/18; A63B 35/00; A63B 69/10; A63B 21/00185; A63B 21/0552; A63B 21/1426; A63B 21/1461; A63B 21/1465; A63B 21/154; A63B 22/0079; A63B 22/0087; A63B 22/0089; A63B 22/20; A63B 22/201; A63B 22/203; A63B 23/03575; A63B 2208/0257; A63B 2244/20

USPC ..... 482/51, 55, 56, 70–74, 129–133, 142, 482/148; 434/254, 255; 441/55, 59–64

See application file for complete search history.

(56) References Cited

U.S. PATENT DOCUMENTS

| | | | |
|---|---|---|---|
| 1,966,448 | A | 7/1934 | Kabisius |
| 2,019,224 | A | 10/1935 | Hess |

(Continued)

*Primary Examiner* — Oren Ginsberg
*Assistant Examiner* — Gregory Winter
(74) *Attorney, Agent, or Firm* — Perkins Coie LLP

(57) ABSTRACT

A swimming resistance trainer including, for example, a frame assembly and a torso support structure attached to the frame assembly. The torso support structure includes a bench rail generally in parallel with a plurality of elongated slide rails of the frame assembly. The torso support structure also includes a bench assembly slidably attached to the bench rail and positioned to elevate a user's torso generally above the bench rail. The trainer further includes armrest mechanisms, a pair of arm resistance members elastically connecting corresponding armrest mechanisms to a portion of the frame assembly, and a pair of leg resistance members elastically connecting corresponding user's legs to a portion of the frame assembly proximate the rear side. The arm resistance members are positioned to resist sliding movement of the armrest mechanisms toward the rear side, and the leg resistance members are positioned to resist movement of the user's legs.

13 Claims, 6 Drawing Sheets

(51) Int. Cl.

| | |
|---|---|
| ***A63B 21/00*** | (2006.01) |
| ***A63B 22/20*** | (2006.01) |
| ***A63B 23/035*** | (2006.01) |

(56) References Cited

U.S. PATENT DOCUMENTS

| | | | | | |
|---|---|---|---|---|---|
| 3,810,614 | A | | 5/1974 | Hessburg | |
| 5,282,748 | A | | 2/1994 | Little | |
| 5,354,251 | A | * | 10/1994 | Sleamaker | 482/96 |
| 5,366,426 | A | | 11/1994 | Glavin et al. | |
| 5,518,472 | A | | 5/1996 | Chen | |
| 5,540,591 | A | | 7/1996 | Doane | |
| 5,997,450 | A | | 12/1999 | Wilkinson et al. | |
| 6,142,912 | A | | 11/2000 | Profaci | |
| 6,196,954 | B1 | | 3/2001 | Chen | |
| 6,764,432 | B2 | | 7/2004 | Hippensteel | |
| 7,390,289 | B2 | | 6/2008 | Wu | |
| 7,585,256 | B2 | | 9/2009 | Harbaugh et al. | |
| 7,601,103 | B2 | | 10/2009 | Chen et al. | |
| 7,722,512 | B2 | | 5/2010 | Liang et al. | |
| 8,550,967 | B2 | | 10/2013 | Zuckerman | |
| 2005/0101464 | A1 | | 5/2005 | Campitelli | |

* cited by examiner

SWIMMING RESISTANCE TRAINER

FIELD OF THE INVENTION

The present invention is generally in the field of physical training. More specifically, the present invention is an apparatus for providing resistance training to swimmers.

BACKGROUND

The act of swimming freestyle requires a combination of skills involving strength, aerobic fitness, flexibility, proprioception and positioning that enable the human body to move efficiently through the water. There are three groups of physical laws that govern all of the techniques used in the act of swimming. They are laws of drag (forces that slow us), motion (propulsion or forces that speed us up) and inertia. Swimming efficiently requires the observance of these laws with respect to minimizing frontal drag, maximizing propulsive forces and maintaining body speed as close to a constant as possible.

With respect to drag forces acting on the swimmer doing freestyle, the sport is somewhat unique in that the very act of the propulsive pulling motion of the arms, as they move through the pull cycle, change the shape of the human body drastically and thus also drastically change the frontal drag forces acting on the body. In addition, since the propulsion is occurring in liquid, in order to maximize the propulsive force of the arm/hand combination, a counter force is required by rotation of the body and a kick that increase the efficiency that is generated with each arm pull. Finally, in order to minimize frontal drag, the body must be kept in alignment from head to toe, while the rotation is occurring.

The amount of frontal drag that is caused by the underwater arm/hand pulling motion is also very different, depending on the position of the arm, forearm and hand, resulting from the articulation of the shoulder, elbow and wrist during this time. The least amount of frontal drag occurs as a result of keeping the upper arm as close as possible to alignment with the line of motion of the body during the early part of the underwater pull. This position, which is called early vertical forearm (EVF), is attained through internal rotation and extension of the shoulder joint during the body rotation. Later in the underwater pull, frontal drag is also reduced through keeping the elbow closer to the surface and sweeping the upper arm more to the side, rather than directly below the body. This described arm motion, although required to reduce frontal drag, is not the position of mechanically greatest strength of the arm throughout the underwater pull. However, based on the observation of some of the world's fastest swimmers, who appear to have a common use of this described motion under water, it appears that the reduction of frontal drag force is more important than maximizing propulsive force.

Acquiring this described pulling motion for swimmers, which for most is neither obvious nor intuitive, requires practice, flexibility and strength development. Being able to rotate the body while simultaneously achieving this pulling motion is also not obvious nor intuitive and requires practice, strength and flexibility. Keeping the body in alignment from head to toe, while achieving this underwater arm motion, also requires strength and practice.

One can acquire these skills in a swimming pool during the course of swimming practice, yet there is still an unmet need to create a swim bench that specifically addresses the need to develop these specific skills on land that will increase freestyle efficiency and speed.

SUMMARY OF INVENTION

It is an object of the present invention to provide to create a swim bench, a device that can be used on land, to simulate the most efficient motions of swimming, to teach the proper freestyle motions and to develop more strength with these required motions.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION OF PREFERRED EMBODIMENTS

Figure 1:
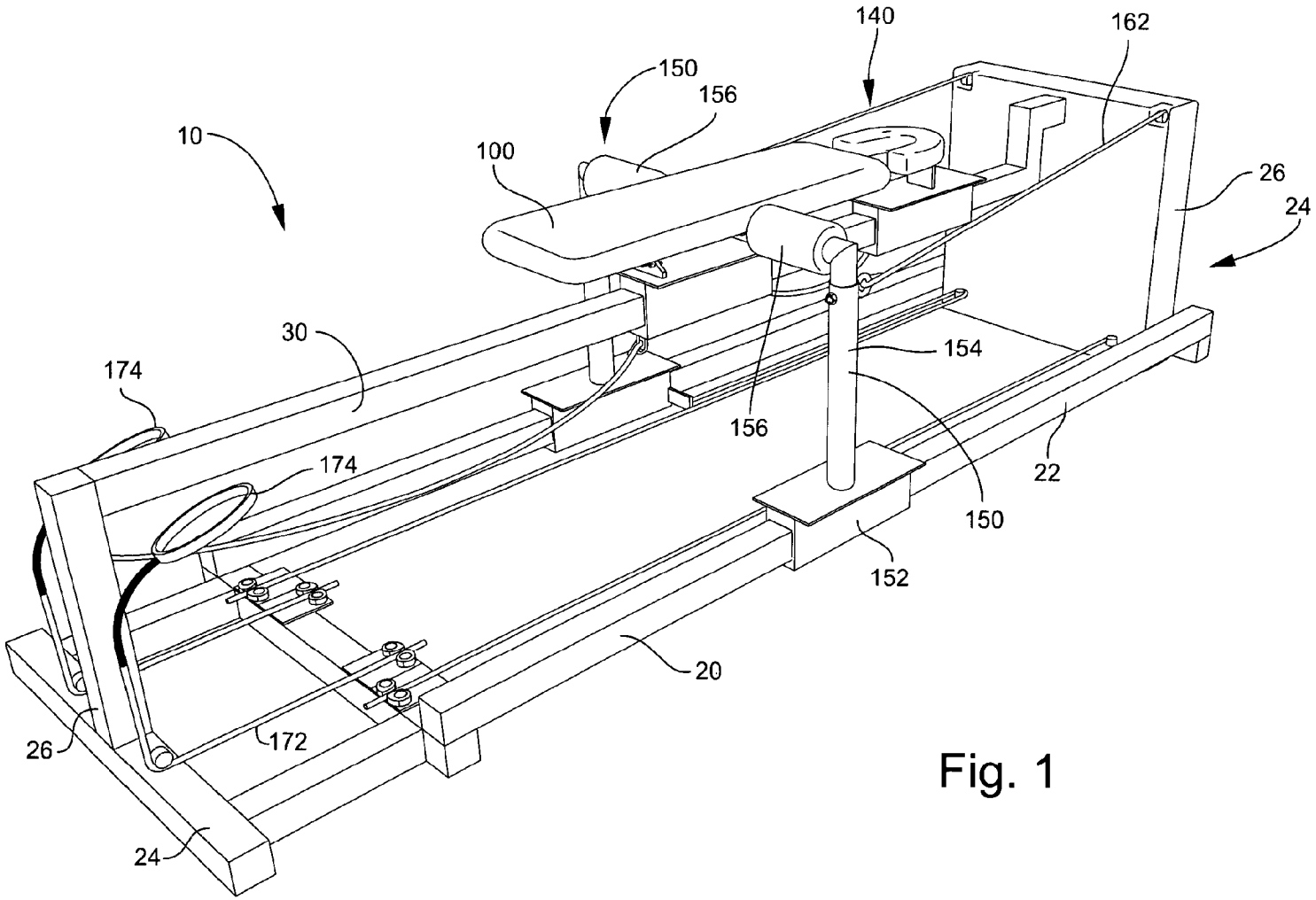
FIG. 1 shows a perspective view of the swim trainer according to the present invention.
Figure 2:
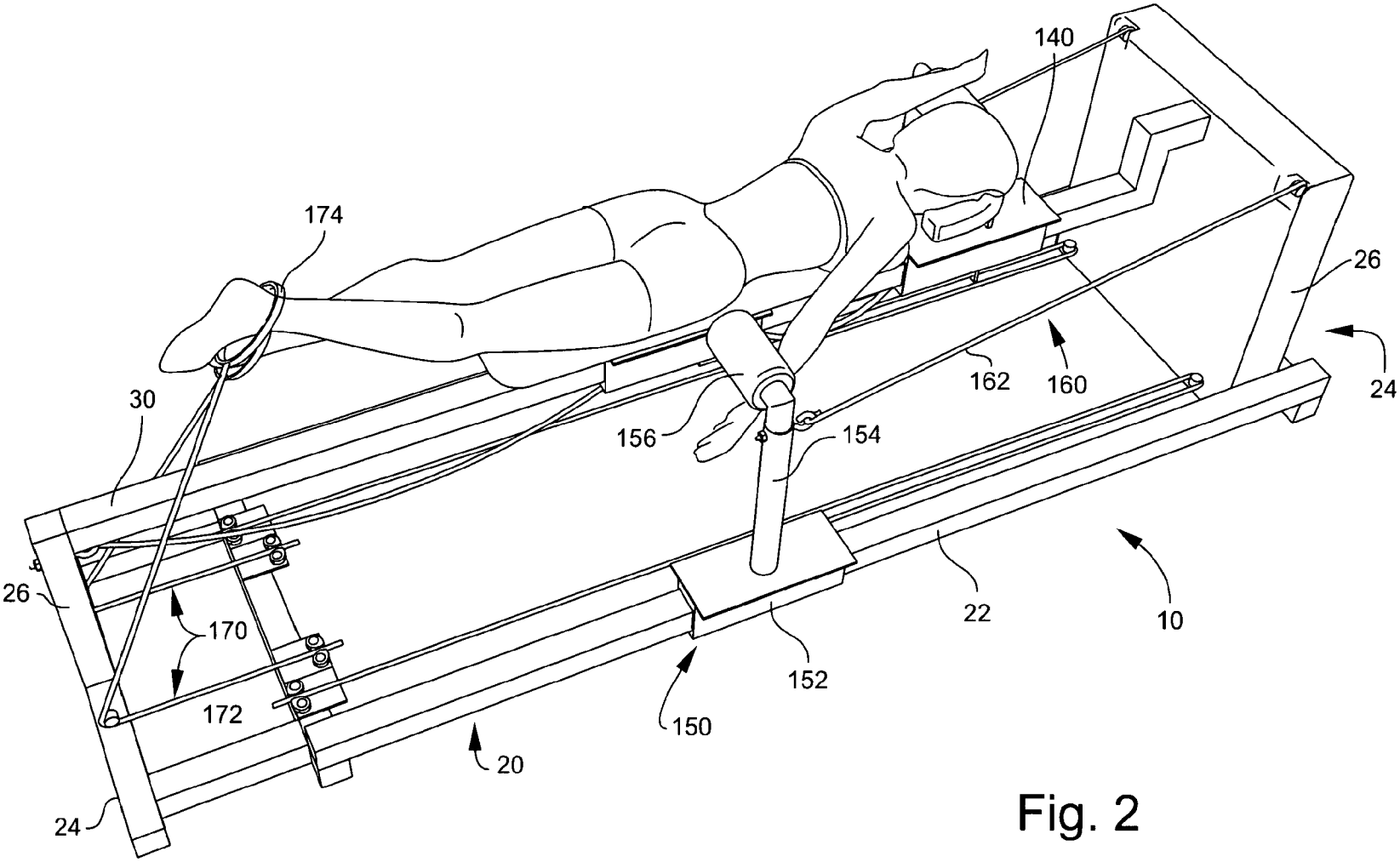
FIG. 2 shows a perspective view of the swim trainer according to the present invention with a user in place.
Figure 3:
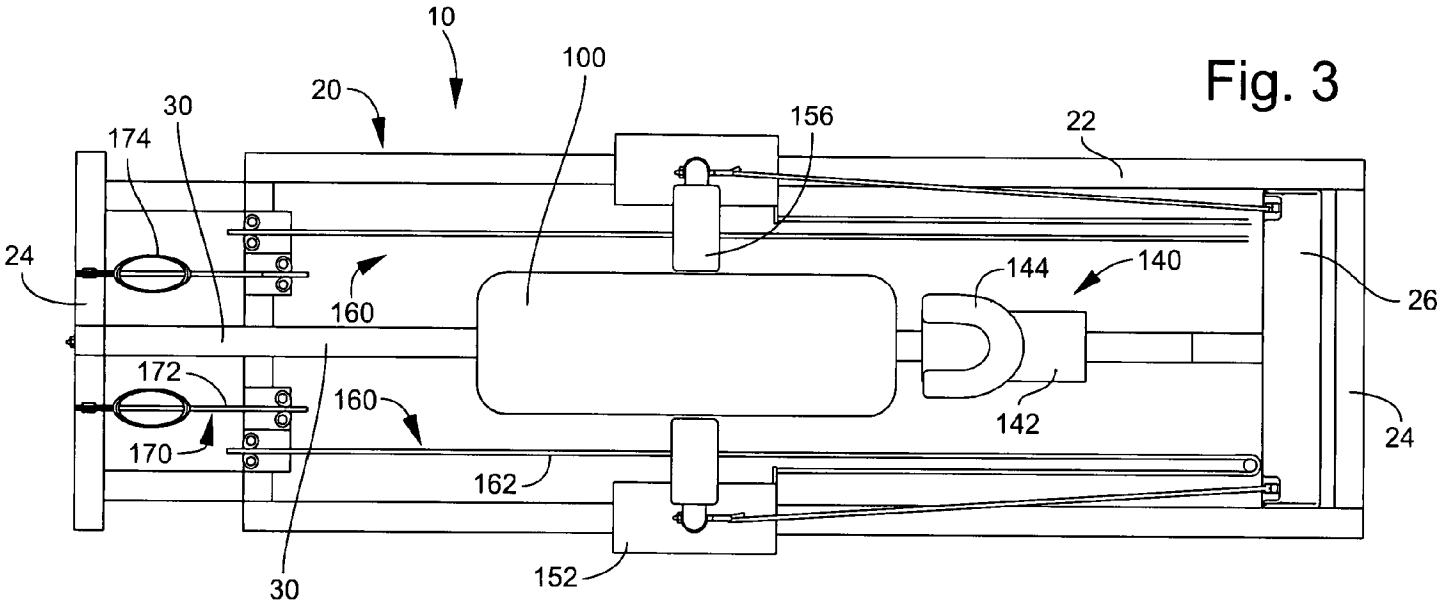
FIG. 3 shows a top view of the swim trainer according to the present invention.
Figure 4:
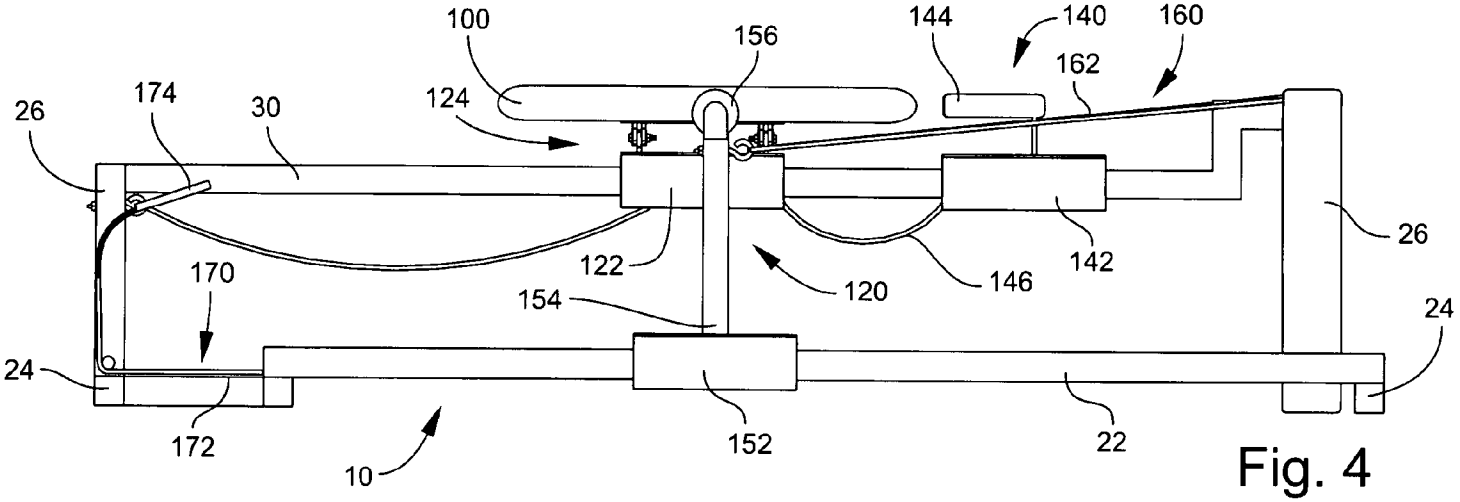
FIG. 4 shows a side view of the swim trainer according to the present invention.
Figure 5:
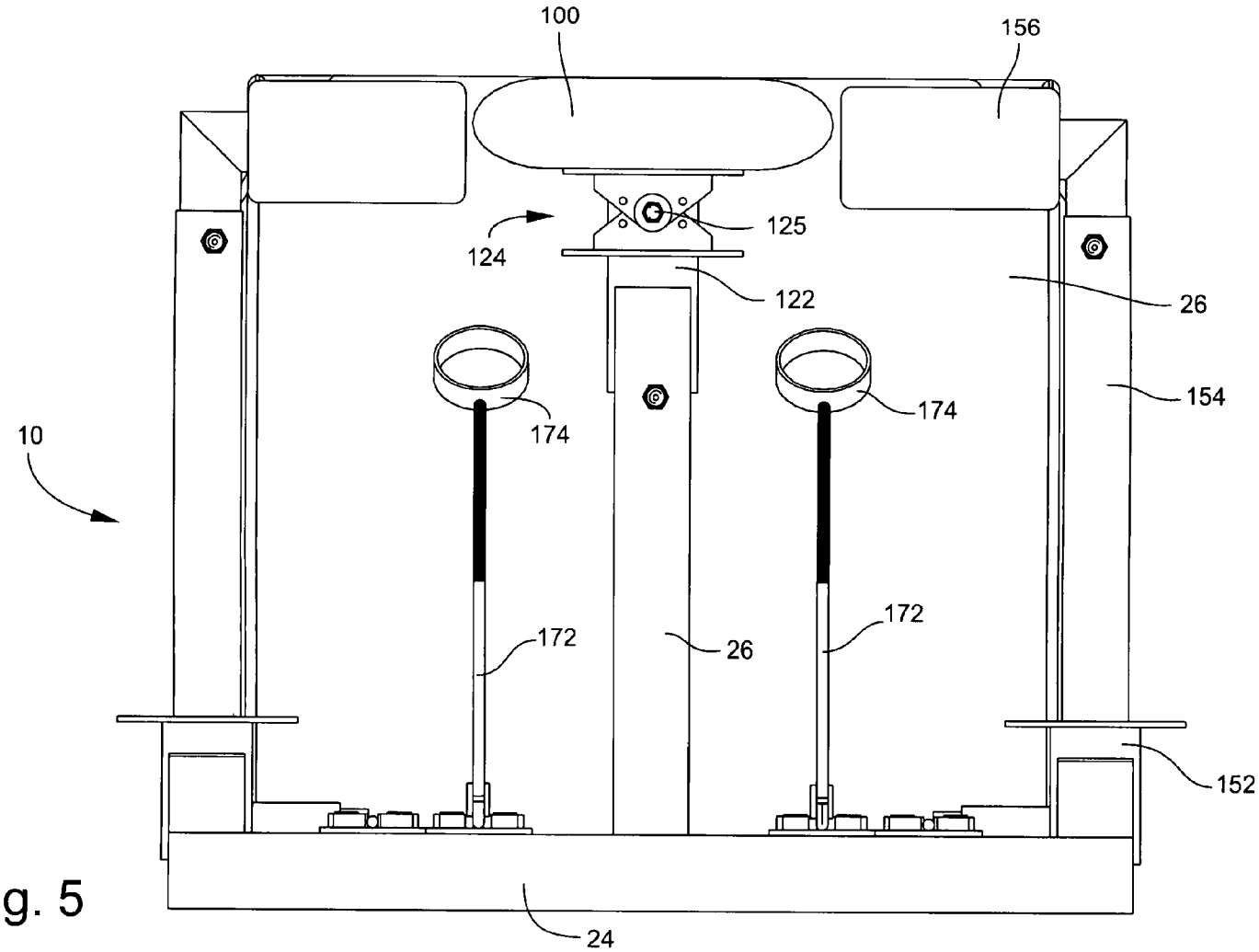
FIG. 5 shows an end view of the swim trainer according to the present invention.
Figures 6A, 6B, 6C:
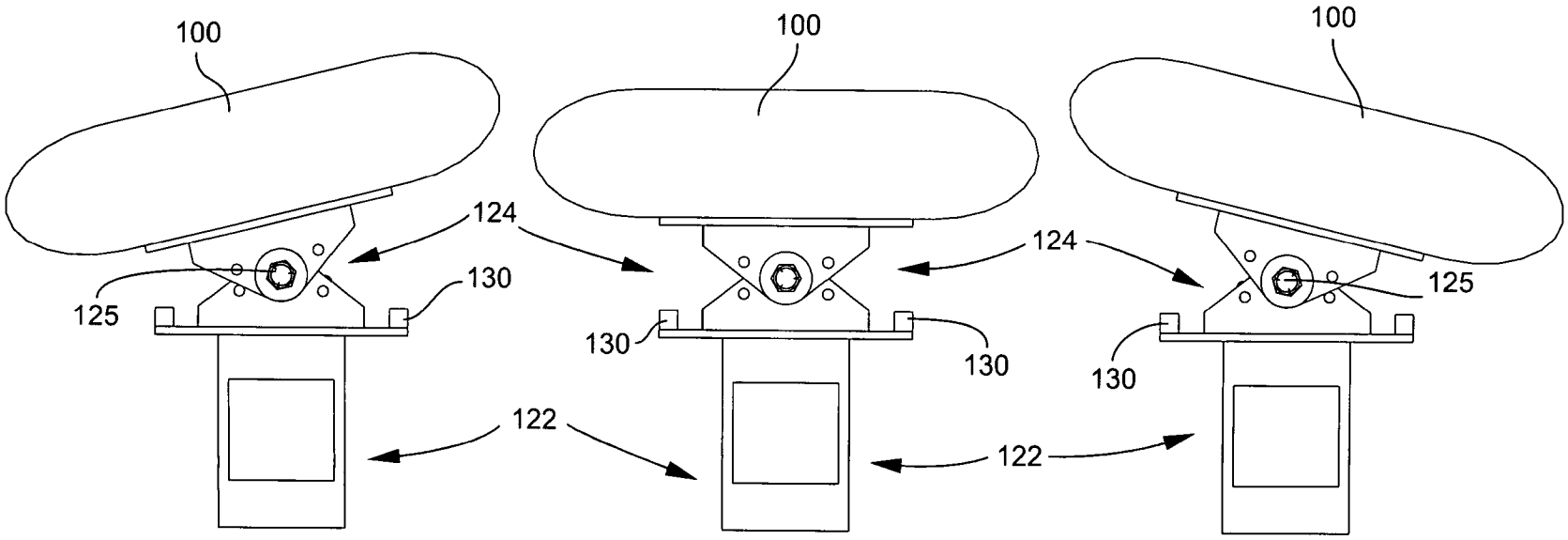
FIGS. 6A, 6B, and 6C show the bench of the swim trainer in three different rotational positions.
Figure 7:
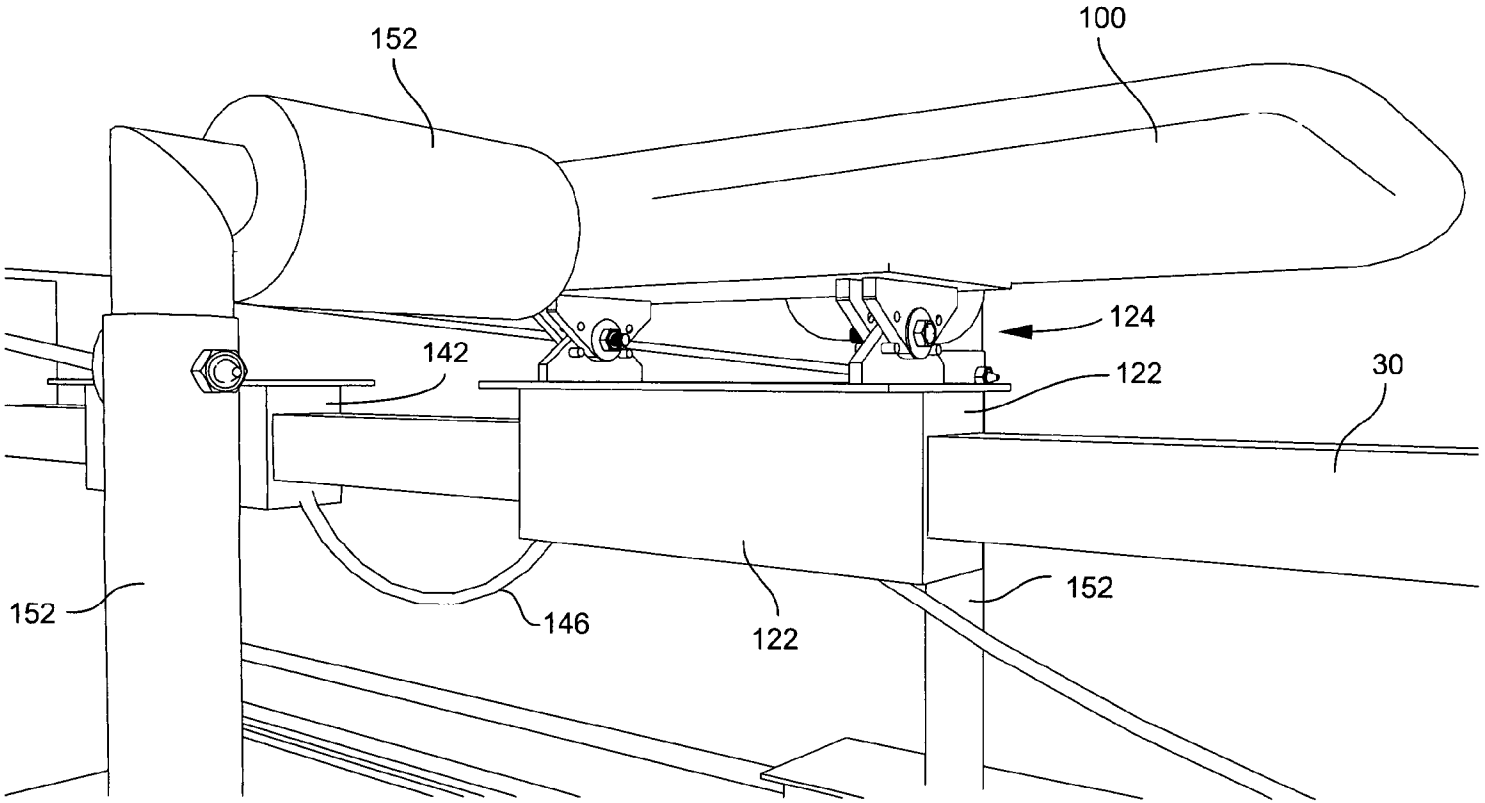
FIG. 7 shows a perspective view of the sliding pivoting mechanism according to the present invention.

The present invention is a device 10 for training swimmers.

The device 10 comprises a generally rectangular base frame 20. The base frame has two long slide rail sides 22 and two short bench mount sides 24. Perpendicularly attached to each short side 22 are front and rear vertical mounts 26. Attached and extending between the front and rear vertical mounts 26 is a bench rail 30.

Slidably attached to the bench rail 30 is a padded bench 100 that is mounted to the bench rail 30 in a generally horizontal position. Preferably, the padded bench 100 may include padded sides (not shown) that are adjustable to accommodate variable widths of swimmers. Further the padded bench 100 may include belts (not shown) attached to the padded bench 100 or padded sides, which go over the top of the swimmer's body to secure it to the bench 100.

The bench 100 is mounted onto a sliding pivot mechanism 120 that has the capability of sliding along the length of the bench rail 30. The sliding pivot mechanism 120 comprises a slide body 122, which includes a slide or bearing mechanism (not shown), and an attached pivotal bench mount 124 for the bench 100. The pivotal bench mount 124 allows the mounted bench 100 to rotate along the long axis of the bench 100 by at least ±20 degrees from perpendicular to the bench axis. The rotation and counter rotation of the bench 100 is caused primarily by the force of a swimmer's pulling motion of the arm/hand, lifting of the swimmer's leg and core (abdominal and lower back) strength.

The rotation of the bench 100 may further include a resistance adjustable mechanism 125. In one embodiment, the resistance adjustable mechanism 125 is a locking nut and bolt located at the axis of rotation, which produces friction resistance to the rotation of the bench 100.

Additionally, it is preferable that the distance of rotation of the bench 100 is restricted by metal stops 130 that limit the total rotation of the bench 100. The rotation of the bench can also be prevented, if desired, by a removable stop pin.

Also slideably mounted to the bench rail 30 is a slideable padded head rest 140. Preferably the head rest 140 is slideably located in front of the padded bench 100. In one embodiment, the head rest 140 has a horseshoe shape. Alternate shapes that can accommodate a users head may be used and are considered a part of the present invention. The head rest 140 comprises a slidable head rest body 142, which includes a slide or bearing mechanism (not shown), and an attached padded head support 144. In one embodiment, the padded head support 144 is non-pivotally attached to the head rest body 142, but in an alternate embodiment, it may be pivotally attached to the head rest body 142. It is important, though, that the padded head support 144 is relocateably attached to the head rest body 142 such that it can be relocated for the comfort of the user. In a preferred embodiment, the slideable padded head rest 140 is tethered to the bench 100 using a short cable, rope, or elastic cord 146; however it can be used in an untethered configuration and still fall within the scope of the present invention.

There are two slideable padded armrests 150 are each attached to one of the long slide rails 22 of the base frame 20. Each slideable padded armrest 150 comprises a slideable arm rest body 152, which includes a slide or bearing mechanism (not shown), and an attached arm support post 154. Attached to the arm support post 154 is an arm support 156 that extends inward from the arm support post 154. The height of the arm support posts are adjustable up and down.

There are two resistance mechanisms, the arm resistance mechanism 160 and the leg resistance mechanism 170. In a preferred embodiment, the arm resistance mechanism comprises at least one cable or cord 162 that is connects each of the slideable padded armrests 150 to a part of the frame 20. Most preferably, one end of the cord 162 is attached at a first end to the slideable arm rest body 152, is threaded through a first pulley's attached at a second end to a front short bench mount side 24 and finally securely attached to a rear short bench mount side 24. In this embodiment, the cord 162 is an elastic cord that provides resistance when moving the slideable padded armrests 150. The resistance may be varied by either adding additional cords 162, or providing a stiffer resistance cord (varying the elasticity of the cord) or by stretching or tightening the existing cords. This resistance also provides for the retraction of the slideable padded armrests 150 after each arm pull. The end position of the retracted arm pad can be adjusted to the correct position by a moveable stop placed along the two slide rails. A hand paddle (not shown) can also be connected to the arm cable 162 and can be used in conjunction with the arm rest 150 or separately. In an alternate embodiment, the second end may be attached to a weight stack in order to the resistance to arm movement or a retractable coil in front of the arm pads, connected by a cable, such as used in an ergometer to measure power.

The leg resistance mechanism 170 comprises at least one leg cable or leg cord 172 that connects strap 174 attached to a user's leg, preferably the ankle, to a part of the frame 20. The leg cord 172 is an elastic cord that provides resistance when moving user's leg. The resistance may be varied by either adding additional leg cords 172, or providing a stiffer resistance cord (varying the elasticity of the cord) or by tightening the existing stretch cord. In an alternate embodiment, one end of the leg cord 172 is attached at a first end to the user's leg, is threaded through at least one pulley attached to the frame 20, with the second end attached either to the frame or to a weight stack in order to the resistance to leg movement.

In use, a swimmer lies face down on the bench 100 with head in the headrest 140, adjusted to the appropriate position so that the swimmer's elbow is located in front of the slideable padded armrests 150. The forearms are placed over the arm pads 150 on each side with the first pull initiated with the right hand forward, the left hand at the rear in the position of the completed pull and the body rotated to the left. The motion is initiated with the right hand by dropping the hand down with the forearm on the armrest 150, pulling against the designated resistance. During the motion of the right arm/hand, the body rotates simultaneously back to the right side until the pull of the right arm is completed. While the right arm is moving through the pulling motion and the body is counter-rotating to the right side, the left arm moves forward assisted by the retraction force on the armrests 150 back to the front position. The left arm then initiates another pull with the body counter-rotating back to the left side and the right arm moving forward again. These motions are repeated as often as needed with the appropriate weight or resistance applied to the hand paddle and/or armrest.

In use, the swimmer may also resistively train their legs by attaching the strap 174 to their leg and kicking against the resistance provided by the leg cords 172. The act of lifting the leg against resistance while simultaneously pulling with the arm and pushing down with the opposite leg helps facilitate the rotation of the bench 100.

One can also use the bench 100 without rotation and by pulling with both arms simultaneously and lifting both legs against resistance to simulate the butterfly stroke. One can remove the head rest 140 from its tether to the bench 100, slide it forward, out of the way, and pull both arms shorter elevating the head, simulating the breast stroke pull.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A swimming resistance trainer, comprising:

a frame assembly having a front side and a rear side opposite the front side, wherein the frame assembly includes a plurality of elongated slide rails generally parallel with one another and extending between the front and rear sides;

a torso support structure attached to the frame assembly, wherein the torso support structure includes— a bench rail generally parallel with the plurality of elongated slide rails and extending toward the rear side of the frame assembly from the front side, and a bench assembly slidably attached to the bench rail and positioned to elevate a user's torso generally above the bench rail when the user is on the bench assembly;

armrest mechanisms;

a pair of arm resistance members elastically connecting corresponding armrest mechanisms to a portion of the frame assembly proximate the front side, wherein the arm resistance members are positioned to resist sliding movement of the armrest mechanisms toward the rear side; and a pair of leg resistance members configured to elastically connect corresponding legs of the user portion of the frame assembly proximate the rear side, wherein the leg resistance members are positioned to resist movement of the user's legs.

2. The swimming resistance trainer of claim 1 wherein the bench assembly comprises:

a slide body, a pivotal bench mount attached to the slide body, and a bench attached to the pivotal bench mount.

3. The swimming resistance trainer of claim 2 wherein the pivotal bench mount is configured to rotate at least ±20 degrees from perpendicular about a long axis of the swimming resistance trainer that extends from the front side to the rear side of the resistance trainer and runs generally in parallel to the bench rail.

4. The swimming resistance trainer of 2 wherein the pivotal bench mount includes a resistance adjustable mechanism positioned to resist pivotal rotation of the bench.

5. The swimming resistance trainer of 2 wherein the bench assembly further includes at least one metal stop attached to either the slide body or the pivotal bench mount, and wherein the at least one metal stop is positioned to limit pivotal rotation of the bench.

6. The swimming resistance trainer of claim 1, further comprising at least one pulley positioned to redirect the direction of the pair of arm resistance members.

7. The swimming resistance trainer of claim 1 wherein each leg resistance member comprises a first end attached to a corresponding leg strap and a second end connected to the frame assembly.

8. The swimming resistance trainer of claim 1, further comprising at least one pulley positioned to redirect the direction of the pair of leg resistance members.

9. The swimming resistance trainer of claim 1 wherein:

the armrest mechanisms comprise a first armrest mechanism and a second armrest mechanism;

the pair of arm resistance members comprise a first arm resistance member and a second arm resistance member; and the first arm resistance member and the second arm resistance member are positioned to resist sliding movement of the first and second armrest mechanisms, respectively, toward the rear side of the frame assembly independently of each other.

10. The swimming resistance trainer of 1 wherein:

the pair of leg resistance members includes a first leg resistance member and a second leg resistance member; and the first leg resistance member and the second leg resistance member are positioned to independently resist movement of the user's legs.

11. The swimming resistance trainer of claim 1, further comprising a head support structure slideably coupled to the bench rail between the torso support structure and the front side of the frame assembly.

12. The swimming resistance trainer of claim 11 wherein the head support structure includes a head rest body and a padded head support releasably attached to the head rest body.

13. The swimming resistance trainer of claim 12 wherein the padded head support has a horseshoe shape.

* * * * *

UNITED STATES PATENT AND TRADEMARK OFFICE

CERTIFICATE OF CORRECTION

PATENT NO. : 9,211,433 B2
APPLICATION NO. : 14/528859
DATED : December 15, 2015
INVENTOR(S) : Gary W. Hall It is certified that error appears in the above-identified patent and that said Letters Patent is hereby corrected as shown below:

In The Specification

In column 3, line 37, delete “users” and insert -- user’s --, therefor.

In The Claims

In column 6, line 4, in claim 4, delete “of” and insert -- of claim --, therefor.

In column 6, line 7, in claim 5, delete “of” and insert -- of claim --, therefor.

In column 6, line 35, in claim 10, delete “of” and insert -- of claim --, therefor.

Signed and Sealed this
Eighth Day of March, 2016

Michelle K. Lee

Michelle K. Lee
*Director of the United States Patent and Trademark Office*